US006108279A

United States Patent [19]

Hara

[11] Patent Number: 6,108,279

[45] Date of Patent: Aug. 22, 2000

[54] STEPPING MOTOR CONTROL DEVICE AND METHOD THEREOF AND TIMEPIECE

[75] Inventor: Tatsuo Hara, Suwa, Japan

[73] Assignee: Seiko Epson Corporation, Tokyo, Japan

[21] Appl. No.: 09/019,676

[22] Filed: Feb. 6, 1998

[30] Foreign Application Priority Data

Feb. 7, 1997 [JP] Japan ..... 9-025676

[51] Int. Cl.[7] ..... G04F 5/00; H02P 8/00

[52] U.S. Cl. ..... 368/157; 318/696

[58] Field of Search ..... 368/76, 80, 157, 368/160, 203–204; 318/696

[56] References Cited

U.S. PATENT DOCUMENTS

| | | | |
|---|---|---|---|
| 5,550,795 | 8/1996 | Takakura et al. | 368/157 |
| 5,889,734 | 3/1999 | Sato | 368/64 |
| 5,933,392 | 8/1999 | Sato et al. | 368/157 |

FOREIGN PATENT DOCUMENTS

| | | |
|---|---|---|
| 54-155079 | 6/1979 | Japan . |
| 55-13838 | 1/1980 | Japan . |
| 60-260883 | 12/1985 | Japan . |
| 2 050 005 | 2/1980 | United Kingdom . |
| 2 030 734 | 4/1980 | United Kingdom . |
| 2 067 795 | 7/1981 | United Kingdom . |
| 2 094 517 | 9/1982 | United Kingdom . |

*Primary Examiner*—Vit Miska

*Attorney, Agent, or Firm*—Stroock & Stroock & Lavan LLP

[57] ABSTRACT

A device for controlling a stepping motor including a first drive pulse supply unit for supplying a first drive pulse to a drive coil for rotating a rotor. A rotation detecting pulse supply part supplies a rotation detecting pulse for detecting whether the rotor has rotated. An auxiliary pulse supply part supplies an auxiliary pulse having an effective power that is greater than the first drive pulse. A level adjustment pulse supply part reduces the effective power of the first drive decrements pulse after the rotor has rotated for a predetermined number of times consecutively. A second drive pulse supply part supplies a second drive pulse for a second predetermined number of time after the auxiliary pulse is supplied.

14 Claims, 9 Drawing Sheets

STEPPING MOTOR CONTROL DEVICE AND METHOD THEREOF AND TIMEPIECE

BACKGROUND OF INVENTION

The present invention relates to a control device for controlling a stepping motor and, in particular, to a device and method for reducing power consumption in electronic watches.

The recent trend is to extend the life of and miniaturize the size of timepieces, such as wristwatches. These objectives can be obtained by reducing the power consumption of the stepping motor used in timepieces which will increase the longevity of the stepping motor and permit the use of a smaller battery thereby conserving space. Also, in recent years, timepieces, such as wristwatches, have been developed in which the battery is replaced with a built-in generator for generating electricity in response to movement of the user's arm. Because it is desirable that these self-generating timepieces be capable of operating continuously for long hours even while left motionless and no electricity is being generated, it is important that power consumption of the stepping motor be minimized.

The stepping motor, also referred to as pulse motor, incremental movement motor or digital motor, is driven by pulse signals and are often used as actuators for digitally controlled devices. Recently, compact-sized electronic devices and information equipment have been developed in which portability is desirable, and compact and light weight stepping motors are in widespread use as actuators for that type of equipment. Representative of such electronic devices are timepieces including electronic watches, time switches and chronographs.

Referring now to FIG. 7, there is shown a timepiece 9, for example a wristwatch, provided with a stepping motor 10, a drive circuit 30 for driving stepping motor 10, a gear train 50 for transferring the force of stepping motor 10 to a second hand 61, a minute hand 62 and an hour hand 63 which are moved by gear train 50. Stepping motor 10 includes a drive coil 11 for producing magnetic force in response to drive pulses output from control device 20, a stator 12 excited by drive coil 11 and a rotor 13 which rotates as a result of the magnetic field excited with stator 12. By selecting a disc-shaped, two-poled permanent magnet for rotor 13, a PM (Permanent Magnet rotation) type stepping motor 10 is formed. Stator 12 is provided with magnetic saturation parts 17 so that opposite magnetic poles that result from the magnetic force generated by drive coil 11 are generated at phases (poles) 15 and 16, respectively, around rotor 13. Also, an internal notching 18 is provided at the appropriate locations on inner periphery of stator 13 so that cogging torque is generated for stopping rotor 13 at appropriate positions.

The rotational energy of rotor 13 is transferred to each of the hands by gear train 50 which includes a fifth wheel 51 which meshes with rotor 13 via a spindle and also meshes with a fourth wheel 52 which meshes with a third wheel 53 which also meshes with a center wheel 54. Center wheel 54 meshes with a minute wheel 55 which meshes with an hour wheel 56. Second hand 61 is mounted on a shaft of fourth wheel 52, minute hand 62 on center wheel 54 and hour hand 63 on hour wheel 56 for displaying time synchronously with the rotation of rotor 13. Of course, a transfer system for displaying the day, month and year (not shown) may also be connected to gear train 50.

In order for timing device 9 to display the time as a result of the rotation of stepping motor 10, stepping motor 10 is supplied with drive pulses which are based on counting signals having a standard frequency (measuring time). Control device 20, which controls stepping motor 10, includes: a pulse synthesizing circuit 22 for generating standard pulses having a standard frequency using a standard oscillation source 21 such as a quartz crystal vibrator, or pulse signals having various pulse widths or timing, and a control circuit 23 for controlling stepping motor 10 based on the various pulses supplied from pulse synthesizing circuit 22. Further, control circuit 23 has a drive control circuit 24 for controlling drive circuit 30 and a detection circuit 25 for detecting whether motor 13 rotated. Drive control circuit 24 includes: a drive pulse supply part 24*a* for supplying drive pulses to drive circuit 30 which in turn drives rotor 13 of stepping motor 10, a rotation-detecting pulse supply part 24*b* for producing, after the drive pulses are output, rotation-detecting pulses to induce induction voltage for determining whether rotor 13 has rotated, an auxiliary pulse supply part 24*c* for producing auxiliary pulses having an effective power that is larger than that of the drive pulses that were output when rotor 13 failed to rotate, a degaussing pulse supply part 24*d* for producing, after an auxiliary pulse is output, a degaussing pulse having a polarity that is opposite as that of the auxiliary pulse for degaussing driving coil 11 and, a level adjustment part 24*e* for adjusting the effective power of the driving pulses. Also, detection circuit 25 detects the presence of rotation of rotor 13 by comparing the induced voltage induced by the rotation-detecting pulses with a predetermined value and feeding back the detection to drive control circuit 24.

Drive circuit 30, which supplies drive pulses for driving stepping motor 10 in response to control signals from drive control circuit 24, includes a bridge circuit composed of series-connected p-channel MOSFET 33*a* and n-channel MOSFET 32*b*, and p-channel MOSFET 33*b* and n-channel MOSFET 32*a*, and is configured to control the voltage to stepping motor 10 from a battery 41. Also, drive circuit 30 includes a pair of resistors 35*a* and 35*b* for detecting rotation, each connected in parallel to p-channel MOSFET 33*a* and 33*b*, respectively, and p-channel MOSFET 34*a* and 34*b* for sampling for supplying chopper pulses to the resistors 35*a* and 35*b*. By applying control pulses having various polarities and pulse widths at respective timing from each of the pulse supply parts 24*a* to 24*e* of the drive control circuit 24 to each of the gates of MOSFETs 32*a*, 33*a*, 33*b*, 34*a* and 34*b*, it is possible to apply to drive coil 11 drive pulses having opposite polarities and pulses for detecting rotation of rotor 13.

Referring now to FIG. 8, there is shown a flow chart of the operation of control device 20. First, in step ST1, standard pulses for measuring time are counted and a one second duration is measured. If it is determined that one second has elapsed, then in step ST2, a drive pulse P1 is produced by drive pulse supply part 24*a*. Next, in step ST3, a rotation detecting pulse SP2 is produced by rotation detecting pulse supply part 24*b* for detecting whether rotor 13 has rotated by comparing the induced voltage with a predetermined value in detection circuit 25. If rotation is not detected, rotation of rotor 13 is ensured in step ST4 by supplying an auxiliary pulse P2 from auxiliary pulse supply part 24*c* to driving coil 11, having effective power that is larger than that of drive pulse P1. After auxiliary pulse P2 is supplied, a degaussing pulse PE is output in step ST5 by degaussing pulse supply part 24*d*. Next, in step ST5, the effective power of drive pulse P1 is increased by one increment by level adjustment part 24*e*.

If, in step ST3, the rotation of rotor 13 is detected, then, in step ST7, a counter n is incremented and, in step ST8, counter n is compared to a first predetermined value NO. If counter n is less than first predetermined value NO, operation returns to step ST1. If counter n is equal to first predetermined value NO, which indicates that rotor 13 has rotated consecutively a number of times equal to first predetermined value NO, level adjustment part 24 reduces the effective power of drive pulse P1 by one increment in step S9. Then, in step ST10, counter n is initialized to zero and the next cycle begins.

Referring now to FIG. 9, there is shown a timing chart illustrating the control signals applied to each of gates GP1, GN1 and GS1 of p-channel MOSFET 33*a*, n-channel MOSFET 32*a* and p-channel MOSFET 34*a*, respectively, for inducing a magnetic field having a polarity in one direction in drive coil 11, and the control signals applied to each of gates GP2, GN2 and GS2 of p-channel MOSFET 33*b*, n-channel MOSFET 32*b* and p-channel MOSFET 34*b*, respectively, for inducing a magnetic field having an opposite polarity in drive coil 11. Control device 20 controls the movement of the hands of timepiece 9 once every second by supplying these control signals to drive circuit 30 for controlling stepping motor 10.

First, at time t1, a control signal for producing drive pulse P1, having a pulse width W10, for example, is supplied by drive pulse supply part 24*a* of drive control circuit 24 to gate GN1 of the n-channel MOSFET 32*a* and to gate GP1 of the p-channel MOSFET 33*a* on the driving pole side (i.e. the side of drive circuit 30 from which drive pulse P1 is output). Following the output drive pulse P1, at time t2, a control pulse for producing rotation detecting pulse SP2 for detecting rotation of rotor 13 is supplied by rotation detecting pulse supplying part 24*b* to gate GP1 of p-channel MOSFET 33*a* and to gate GS1 of the MOSFET 34*a* for sampling voltage on the driving pole side. Rotation detection pulse SP2 is a chopping pulse, having duty cycle of about ½, and causes the current induced in drive coil 11 when rotor 13 rotates to be output to rotation detecting resistor 35*a*. The voltage across rotation detecting resistor 35*a* is compared to a predetermined value in detection circuit 25 to determine whether rotor 13 has rotated. If the voltage induced by rotation detecting pulse SP2 does not reach the predetermined value, it is determined that rotor 13 did not rotate and, in step ST4 at time t3, a control pulse for producing auxiliary pulse P2 is supplied by auxiliary pulse supply part 24*c* to gate GN1 of the n-channel MOSFET 32*a* and to gate GP1 of the p-channel MOSFET 33*a* on the driving pole side. Auxiliary pulse P2, having a pulse width W20 and therefore more effective power larger than drive pulse P1 (where W20>W10), contains sufficient energy to ensure that rotor 13 rotates. After auxiliary pulse P2 is supplied in step ST5 at time t4, a control pulse for outputting degaussing pulse PE is supplied by degaussing pulse supply part 24*d* to gate GN2 of n-channel MOSFET 32*b* and to gate GP2 of the p-channel MOSFET 33*b* on the opposite pole side (reverse pole side). Degaussing pulse PE, which has a polarity that is opposite as that of auxiliary pulse P2, reduces the residual magnetic flux in stator 12 and drive coil 11 that is generated by the large effective power of auxiliary pulse P2. After degaussing pulse PE is supplied and drive pulse P1 is incremented in step ST6, one cycle of operation for diving stepping motor 10 is completed and rotor 13 is successfully rotated by one rotation angle.

At time t11, which is one second after time t1, the next cycle for rotating rotor 13 by one rotation angle begins. In this cycle, MOSFETes 32*b*, 33*b* and 34*b* which were on reverse pole side in the previous cycle are now on the driving pole side. As in the previous cycle, this cycle begins with drive pulse P1 being supplied at time t11. However, if auxiliary pulse P2 was produced in the previous cycle, a drive pulse P1', having effective power raised by one increment by level adjustment part 24*e* (e.g. drive pulse P1' having a pulse width W11, where W11>W10), is supplied at time t11. Next, at time t12, pulse SP2 is supplied for detecting rotation of rotor 13 and, if no rotation is detected, then, at time t13, auxiliary pulse P2 is output followed by degaussing pulse PE at time 14.

In the next cycle beginning at time t21, a drive pulse P1" having an even wider pulse width, W12 (where W12>W11), is supplied. At time t22, rotation detecting pulse SP2 is output and, if rotation of rotor 13 is detected, which is likely because drive pulse P1" has a high effective power, the cycle ends. After rotor 13 was rotated NO consecutive times in response to drive pulse P1", drive pulse P1" is decremented by level adjustment part 24*e* and drive pulse P1', having an effective power that is one increment lower than drive pulse P1", is supplied in the next cycle beginning at time t31.

Accordingly, drive pulses having low effective power that is sufficient for continuously driving rotor 13 are supplied so that a small, thin timepiece 9 having accurate hands movements, low power consumption and long life can be provided.

In the conventional system described above, when drive pulse P1 generates insufficient torque to rotate rotor 13 and auxiliary pulse P2 is required to ensure that rotor 13 rotates, the effective power of drive pulse P1 is increased by one increment for the next cycle. However in many cases, a one increment increase in drive pulse P1 also may not be sufficient to rotate rotor 13 and, as a result, a drive pulse increased by two or three increments is supplied. Higher power drive pulses maybe required to drive rotor 13 because of a large increase in meshing load due to a minute variation in positional relationship between the wheel shafts and bearings or variation of meshing positions between wheels as gear train 50 undergoes large torque variations after auxiliary pulse P2 is supplied. Also, because gear train 50, which transmits kinetic energy from stepping motor 10 to the hands, is composed of a plurality of gear wheels, there are times when the meshing load increases periodically due to tolerances in manufacturing or the assembling process of the gear wheels. Once the effective power level of drive pulse P1 is increased by two or three increments and is sufficient to rotate rotor 13, the effective power level of this higher power drive pulse is decremented by one level after a number of rotations of rotor 13, for example, NO rotations, and the effective power of the drive pulse returns to the initial effective power level of drive pulse P1 after an additional consecutive NO rotations. If the meshing load increases at any point in this sequence, the effective power level of the drive pulse is again increased by one or two or even more increments. Therefore, even after rotor 13 has rotated a sufficient amount so that the meshing load condition of gear train 50 is at the level it was before auxiliary pulse P2 was supplied thereby reducing the torque necessary for rotation of rotor 13 to a low level, the effective power of the drive pulse still remains at a somewhat higher level, for example, one or two increments or more, than the minimum required to rotate rotor 13.

In the control method described above, the effective power of drive pulse P1 increases by one increment when the meshing load increases in one angle of rotation of rotor 13 and auxiliary pulse P2 is produced, and the effective power of drive pulse P1 increases by two increments if the meshing load increases during two angles rotation in a given cycle of operation of gear train 50. Furthermore, if the condition of gear train 50 varies due to the torque applied by auxiliary pulse P2, larger torque will still be required to rotate rotor 13 for two or three increments of rotation angle. Accordingly, in the conventional system, even though a control method is used which seeks to supply a drive pulse having the minimum effective power that is sufficient for rotating rotor 13, in many instances the drive pulse that is supplied has an energy level that is several increments higher than the minimum necessary to rotate rotor 13.

Accordingly, it is an object of this invention to provide a control device and method for further reducing the driving power of stepping motor 10 by applying drive pulses having the lowest possible effective power for driving rotor 13 in periods of higher gear train 50 efficiency even though at other periods efficiency worsens due to meshing conditions of gear train 50 caused by auxiliary pulse P2 or manufacturing/assembly tolerances.

A further object of this invention is to provide a control device and method for realizing a small-sized, long-life timepiece having a built in electricity generator that can keep time continuously even after being left motionless for long hours.

SUMMARY OF THE INVENTION

A control device is provided that reduces the power required to drive a stepping motor by supplying a drive pulse having an increased effective power only for a predetermined period after an auxiliary pulse is supplied so that a rotor rotates even during periods of increasing meshing loads, and supplying a drive pulse having a predetermined lower effective power when the meshing load is decreased. The present invention is for a control device and method for controlling a stepping motor which rotatably drives a multi-poled rotor within a stator having a drive coil. A first drive pulse supply part supplies a first drive pulse to a drive coil for driving a rotor. A rotation detection pulse supply part outputs a rotation detecting pulse for determining whether the rotor rotated in response to the first drive pulse. An auxiliary pulse supply part supplies an auxiliary pulse, having an effective power that is larger than that of the first drive pulse, when rotation of the rotor is not detected. A second driving pulse supply part supplies a second drive pulse having an effective power level one or several increments higher than the effective power level of a first drive pulse but less than the effective power of the auxiliary pulse. The level of the second drive pulse is adjusted by a level adjustment pulse supply part and is output for a second predetermined number of times after the auxiliary pulse is supplied. The second drive pulse supply part controls the effective power of the second drive pulse by either varying its pulse width or voltage.

By providing a second drive pulse supply part, it is possible to supply a second drive pulse, having larger effective power than the first drive pulse, for a short period of time for rotating the rotor even while the meshing load of the gear train is increased. In this way, the effective power of the first drive pulse is not increased and may even be reduced if the rotor rotates a predetermined number of times. Accordingly, the power consumption of the stepping motor may be further reduced by supplying the first drive pulse having the minimum required energy level necessary to rotate the rotor. Also, repeated application of the auxiliary pulse which increases power consumption, can be prevented, because the second drive pulse, having a larger effective power than the first drive pulse but less than the auxiliary pulse, is supplied after the auxiliary pulse during an increment of rotation angle in which the meshing load is increased.

Also, because an increased meshing load, which necessitates a drive pulse having a larger effective power to drive the rotor, generally occurs for only a very short period of time, i.e. through only one or several rotation angles of the rotor, the rotor may be successfully rotated during this period by delaying the output of a degaussing pulse, having a polarity that is opposite as that of the auxiliary pulse, from a time immediately after the output of the auxiliary pulse to a time immediately before the output of the next drive pulse thereby increasing the substantial effective power of the drive pulse. In particular, in the control device and method of controlling a stepping motor of the present invention, a drive pulse supply unit supplies a first drive pulse to the drive coil for rotating the rotor. A rotation detecting pulse supply unit supplies a rotation detecting pulse for detecting whether the rotor has rotated in response to the first drive pulse. An auxiliary pulse supply unit supplies an auxiliary pulse, having an effective power that is larger than that of the first drive pulse, when rotation of the rotor is not detected. A level adjustment pulse supply part decrements the effective power of the first drive pulse after the rotor has rotated a first predetermined number of times consecutively. An auxiliary pulse supply part supplies an auxiliary pulse, having an effective power that is larger than that of the drive pulse, when rotation of the rotor is not detected. A degaussing pulse supply part supplies a degaussing pulse, having an opposite polarity to that of the auxiliary pulse, immediately before the output of a drive pulse that is supplied in a cycle that follows a cycle in which the auxiliary pulse is supplied.

By applying the degaussing pulse immediately before the next drive pulse is supplied, the effective power of the drive pulse is substantially increased without having to increase the actual power level of the drive pulse. Accordingly, even during periods in which the meshing load has not increased, it is possible to supply a drive pulse having an increased effective power while reducing its actual power to the minimum level required to rotate the rotor. Thus, it is possible to provide a control device and method for controlling a stepping motor in which the rotation of the rotor is ensured and power consumption is reduced.

As stated above, it is possible to provide a small-sized, high-precision, long-life timepiece that consumes minimal power by using the control device of the present invention for reliably rotating the stepping motor of the timepiece and a pulse synthesizing circuit for producing pulse signals having a plurality of frequencies. Also, it is possible to provide a timepiece which can drive the timepiece hands for several hours even while the timepiece is left motionless by employing the device and method for control of the present invention in a timepiece incorporating a power generating device.

Further, the method for controlling a stepping motor according to the present invention can be implemented in a computer-readable medium such as a logic circuit or a control program for a microprocessor. Also the present invention is not limited to only timepieces but may be used in any device which drives a motor and requires low power consumption and high precision.

Accordingly, it is an object of this invention to provide a control device and method for further reducing the driving power of stepping motor 10 by applying drive pulses having the lowest possible effective power for driving rotor 13 in periods of higher gear train 50 efficiency even though at other periods efficiency worsens due to meshing conditions of gear train 50 caused by auxiliary pulse P2 or manufacturing/assembly tolerances.

A further object of this invention is to provide a control device and method for realizing a small-sized, long-life timepiece having a built in electricity generator that can keep time continuously even after being left motionless for long hours.

Still other objects and advantages of the invention will in part be obvious and will in part be apparent from the specification.

The invention accordingly comprises the features of construction, combinations of elements, and arrangement of parts which will be exemplified in the constructions hereinafter set forth, and the scope of the invention will be indicated in the claims.

DESCRIPTION OF THE PREFERRED EMBODIMENTS

Figure 1:
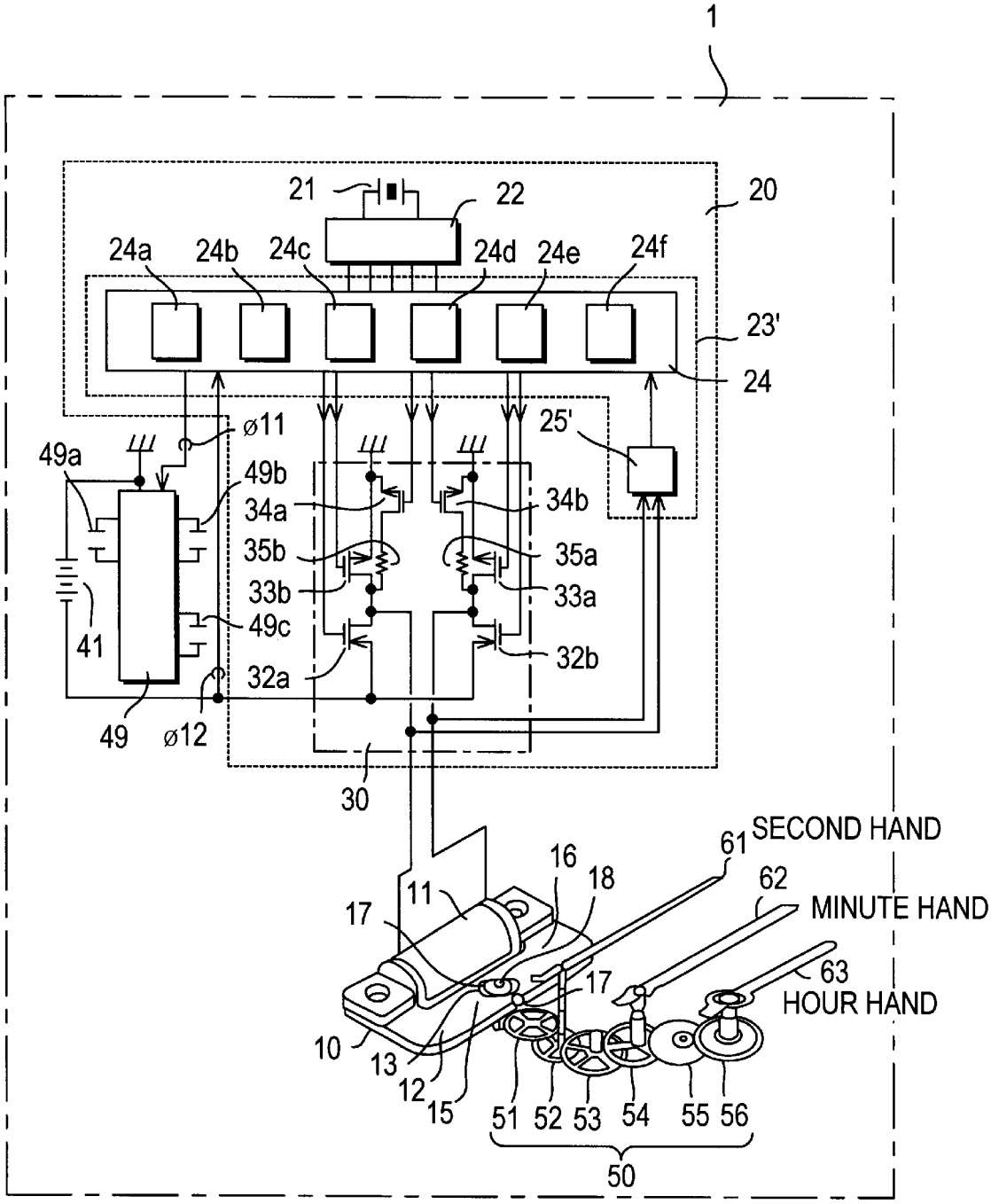
FIG. 1 is a schematic representation of a timepiece including a stepping motor and a generation device constructed in accordance with the present invention.
Figure 7:
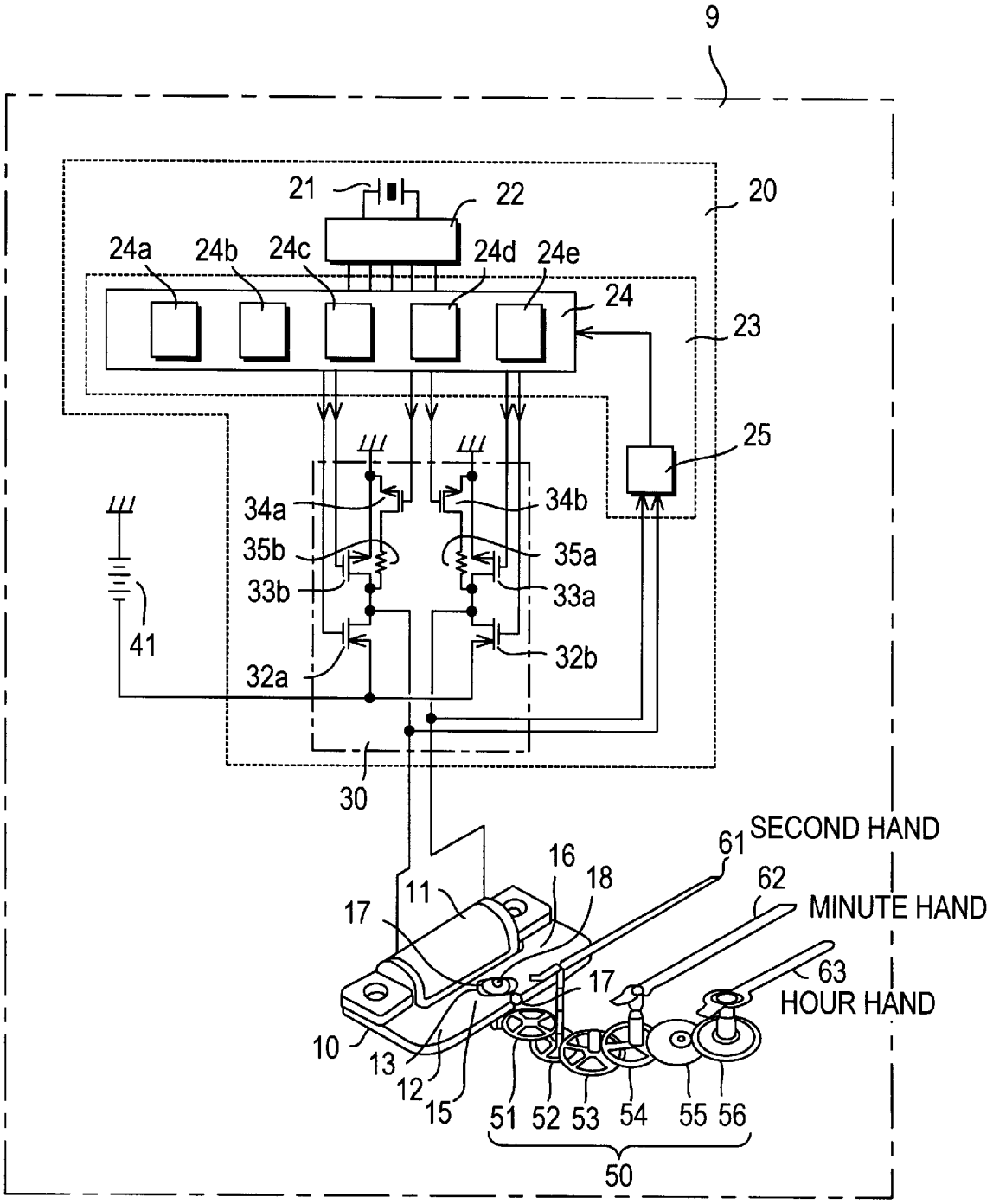
FIG. 7 PRIOR ART
FIG. 7 is a schematic representation of a prior art timepiece.

Referring now to FIG. 1, there is shown a schematic diagram of a timepiece 1 in accordance with the first embodiment. In timepiece 1, stepping motor 10 is driven by control device 20 and the movement of stepping motor 10 is transferred via gear train 50 to second hand 61, minute hand 62 and hour hand 63. Because the basic construction of stepping 10, gear train 50 and control device 20 is the same as described above with respect to FIG. 7, common elements will be denoted with like reference numerals and the detailed description thereof will be omitted.

Control circuit 23' employed in control device 20 of timepiece 1 includes drive control circuit 24 and detection circuit 25'. Drive control circuit 24 includes first drive pulse supply part 24*a* for supplying drive pulse P1 to drive coil 11 through drive circuit 30, rotation-detecting pulse supply part 24*b* for producing a rotation-detecting pulse SP2 after drive pulse P1 is output, auxiliary pulse supply part 24*c* for producing auxiliary pulse P2 having a larger effective power than drive pulse P1, degaussing pulse supply part 24*d* for producing degaussing pulse PE after auxiliary pulse P2 is supplied, a second drive pulse supply part 24*f* for supplying second drive pulse P11, having an effective power that is several levels larger than that of drive pulse P1 but less than the effective power of auxiliary pulse P2, for a second predetermined number of times (a cycle of MO times in the example) consecutively after auxiliary pulse P2 is output, and a level adjustment part 24*e* for controlling the effective power of drive pulse P1 and second drive pulse P11.

Also, timepiece 1 of the present invention derives electrical power from a battery 41 that is electrically connected to drive circuit 30 of control device 20 through a voltage step-up step-down circuit 49. Voltage step-up step-down circuit 49 performs multi-stepped step-up and step-down power regulation by utilizing a plurality of capacitors, 49*a*, 49*b* and 49*c*, for controlling the voltage applied to drive circuit 30 by the control signals supplied by drive control circuit 24 of the control device 20. The output voltage of voltage step-up step-down circuit 49 is supplied to drive control circuit 24 and is monitored by signal $\phi$ 12. The effective power of first drive pulse P1 and second drive pulse P11 is determined by level adjustment part 24*e* that controls voltage step-up step-down circuit 49 and varies the pulse width and voltage of the pulses. In this way, the effective power of pulses used to drive rotor 13 is finely controlled thereby increasing power conservation.

Figure 2:
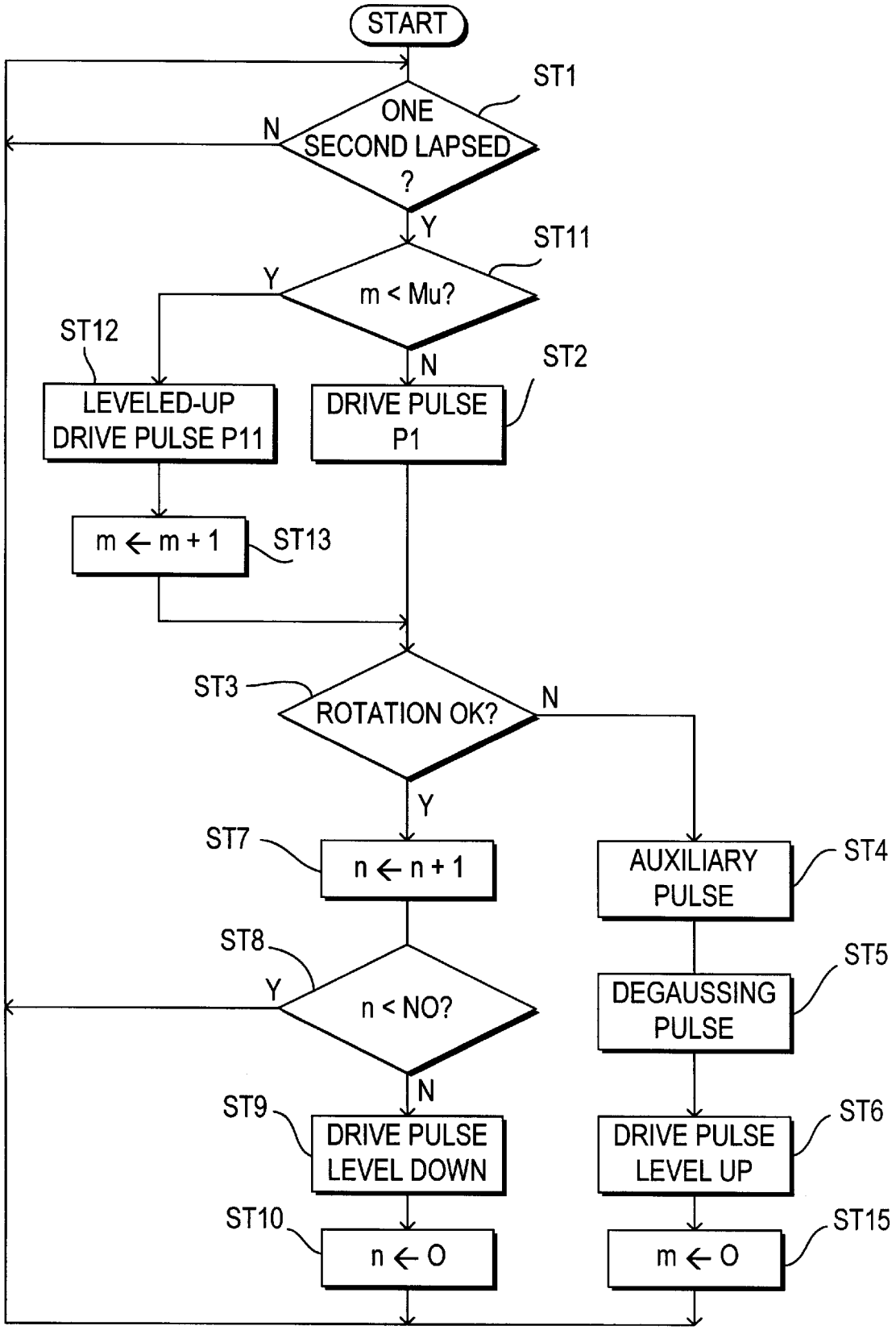
FIG. 2 is a flow chart illustrating the control method of the control device shown in FIG. 1.
Figure 8:
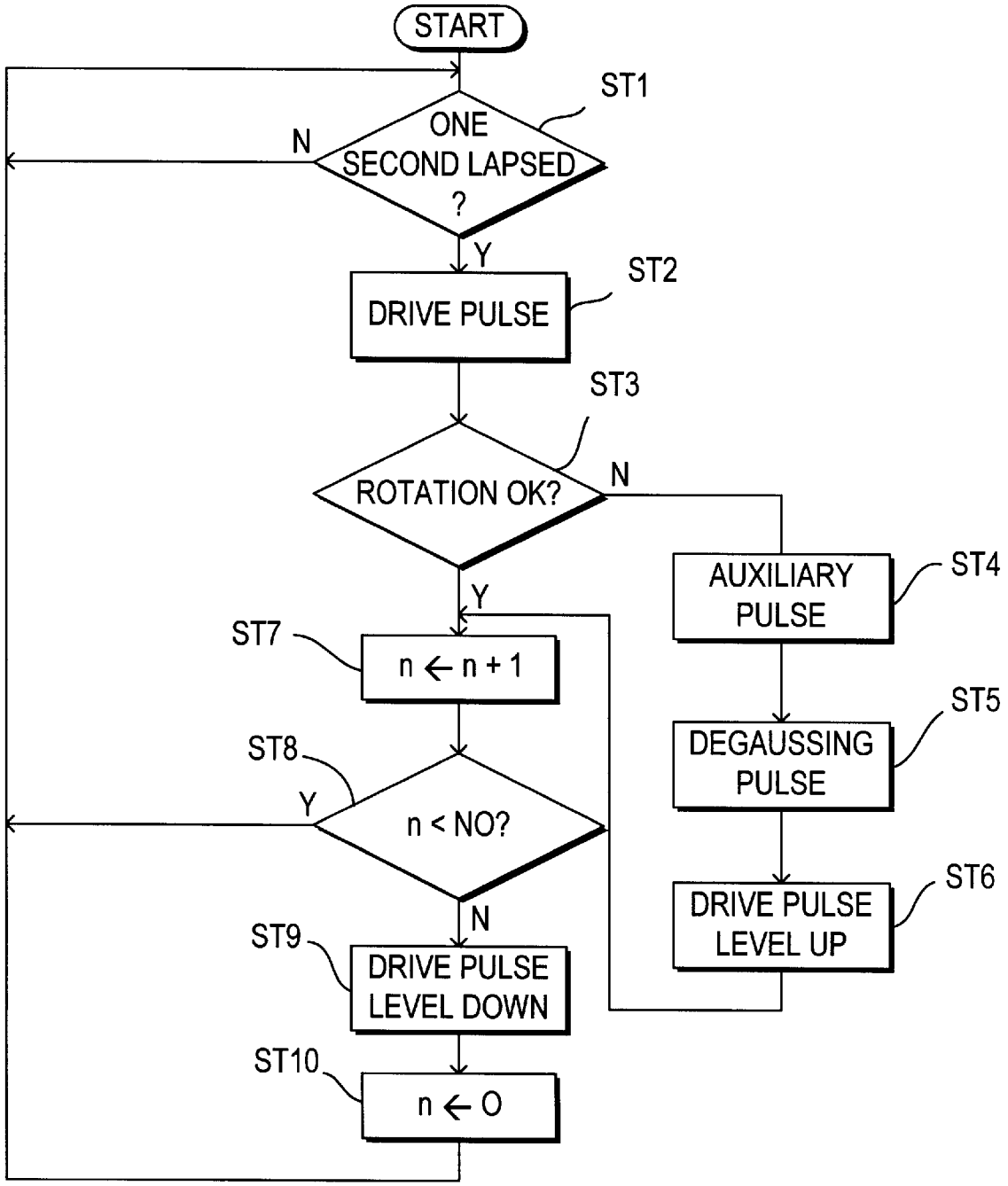
FIG. 8 PRIOR ART
FIG. 8 is a flow chart illustrating the timepiece of the control device in accordance with the prior art.

Referring now to FIG. 2, there is shown a flow chart of the method for controlling stepping motor 10 employed in timepiece 1 according to the present embodiment. Flowchart steps that correspond to steps previously described in FIG. 8 are denoted by the same reference numerals and a detailed description thereof is omitted.

First, in step ST1, one second of time is measured for the movement of the hands. If it is determined that a second has elapsed, then in step ST2, it is determined whether the value of a counter m has reached second predetermined number MO. If the value counter m is equal to second predetermined number MO, the method proceeds to step ST2 and drive pulse P1 is output under the control of first drive pulse supply part 24*a*. If counter m is less than second predetermined number MO, the method proceeds to step ST12 and second drive pulse P11, having a larger effective power than drive pulse P1, is output under the control of second drive pulse supply part 24*f* instead of first drive pulse P1. Then, in step ST13, counter m is incremented.

Auxiliary pulse P2 is usually supplied when there is low rotation efficiency due to poor meshing condition of gear train 50 caused by either manufacturing and assembly tolerances or a change in condition of gear train 50 caused by auxiliary pulse P2. However, because the periods of increased meshing load is limited to one, or at MOSFETt a few, increments of rotation of rotor 13, the meshing load in many cases returns to its initial low level after a few rotations of rotor 13. Accordingly, it is possible to overcome the effects of increased meshing load by applying second drive pulse P11, having an effective power that is larger than drive pulse P1 but less than auxiliary pulse P2, following the cycle in which auxiliary pulse P2 is output. After the meshing load returns to its lower level, normal hand movements of timepiece 1 may be performed by drive pulse P1 having the smaller effective power as previously supplied.

After the application of either first drive pulse P1 or second drive pulse P11, in step ST3 rotation detecting pulse supply part 24*b* outputs rotation detecting pulse SP2 for determining whether rotor 13 has rotated. If the rotation of rotor 13 is not detected, auxiliary pulse P2 is output in step ST4 by auxiliary pulse supply part 24*c* and, in step ST5, degaussing pulse PE is output by degaussing pulse supply part 24*d*. Thereafter, in step ST6, the effective power of drive pulse P1 is raised by one increment level and, in step ST15, counter m is initialized to zero so that second drive pulse P11 is output in the next m cycles.

If the rotation of rotor 13 is detected in step ST3, counter n is incremented in step ST7, and, in step ST8, counter n is compared with a first predetermined number NO. If counter n is equal to first predetermined number NO, then in step ST9 the effective power of first drive pulse P1 is decremented by one level one and counter n is then cleared in step ST10.

Figure 3:
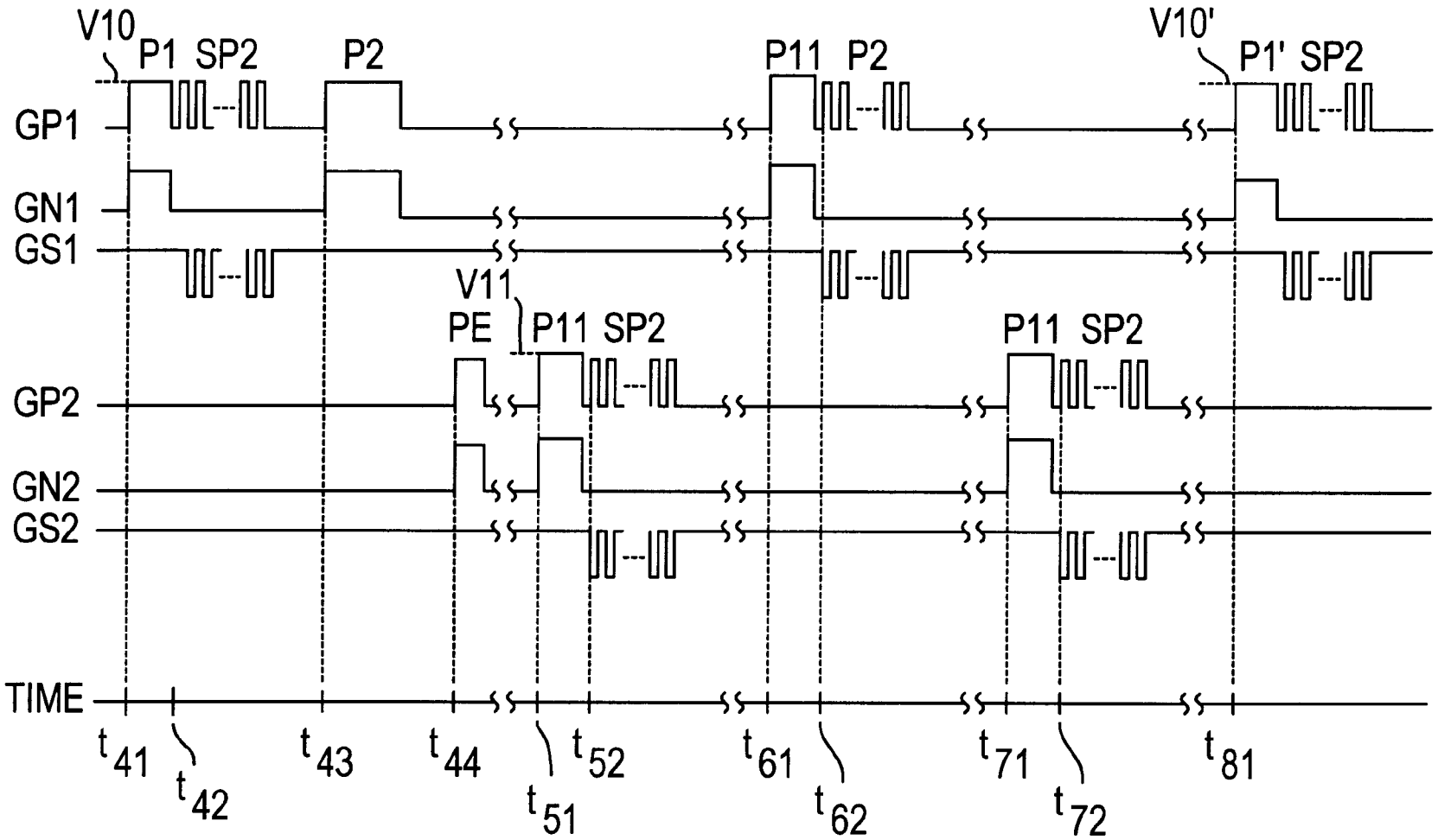
FIG. 3 is a timing chart illustrating the operation of the control device in accordance with the method of FIG. 1.
Figure 9:
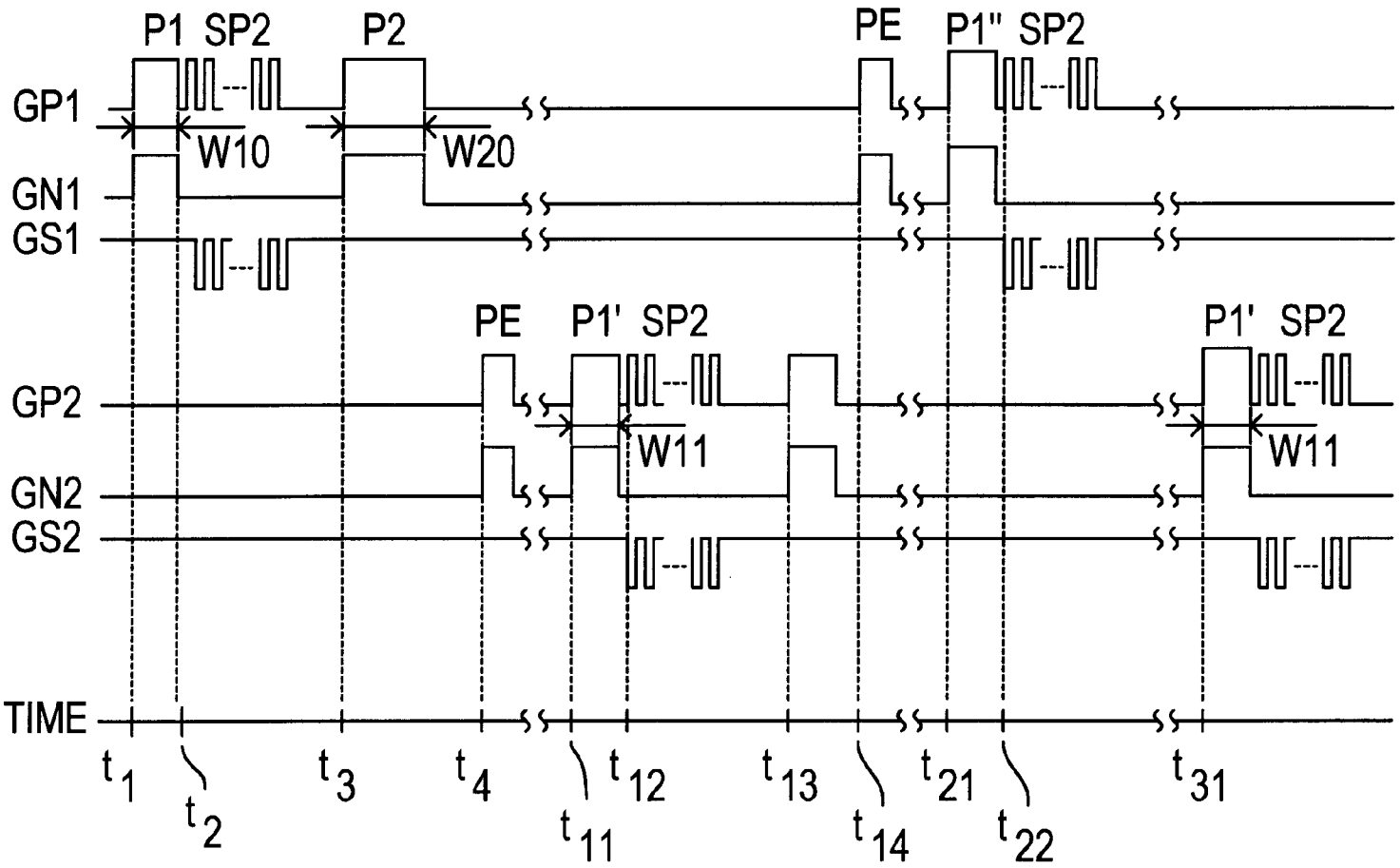
FIG. 9 PRIOR ART
FIG. 9 is a timing chart illustrating the operation of the control device in accordance with the prior art.

Referring now to FIG. 3, there is shown a timing chart illustrating the operation of control device 20 in the present embodiment. As with the example previously described in FIG. 9, FIG. 3 illustrates the control signals applied to each of gates GP1, GN1 and GS1 of p-channel MOSFET 33*a*, n-channel MOSFET 32*a* and p-channel MOSFET 34*a*, respectively, for exciting a magnetic field of one polarity on the drive pole side of drive coil 11 and the control signals to be applied to each of gates GP2, GN2 and GS2 of p-channel MOSFET 33*b*, n-channel MOSFET 32*b* and p-channel MOSFET 34*b*, respectively, for exciting a magnetic field having a reverse polarity. Like elements to those described in FIG. 9 are denoted by the same references numerals and a description thereof is omitted.

Initially, when one second of time has lapsed in step ST1, first drive pulse P1, having a voltage V10, is output at time t41 because auxiliary pulse P2 has not been supplied in the previous m cycles. Next, at time t42 in step ST3, rotation detecting pulse SP2 is supplied and if no rotation is detected, auxiliary pulse P2 is outputted at time t43 in step ST4. After the output of auxiliary pulse P2, degaussing pulse PE is supplied at time t44 in step ST5, thus completing one cycle.

After one second has elapsed from time t41, the next cycle starts. Because auxiliary pulse P2 was outputted in the previous cycle, counter m equals 0, and because counter m is less than second predetermined number MO, second drive pulse P11, having an effective power of V11 that is larger than that of first drive pulse P1 (where V11>V10), is output at time t51 in step ST 12 under the control of second drive pulse supply part 24*f*.

After the output of second drive pulse P11, rotation detecting pulse SP2 is output at time t52 in step ST3 for detecting whether rotor 13 has rotated. In the next cycle, second drive pulse P11 is also applied at time t61 and rotation detecting pulse SP2 is outputted at time t62. Also, in the next cycle, second drive pulse P11 is applied at time t71 and rotation detecting pulse SP2 is applied at time t72. Finally, in the next cycle at time t81, assuming, for example, that second predetermined number MO is set to 3, counter m is equal to second predetermined number MO. Consequently, the method proceeds from step ST11 to step ST2, and, at time t81, first drive pulse P1' is supplied having a voltage 10' and an effective power that is one level higher than that of first drive pulse P1 used in the cycle previous to the one in which auxiliary pulse P2 was applied (at time t43).

As stated above, when the meshing load for driving rotor 13 increases and auxiliary pulse P2 is required to drive rotor 13, the conventional control device 20 raises the effective power of the drive pulse (in this example, first drive pulse P1) incrementally by one level for each cycle during increased meshing loads. In contrast, in the present embodiment, the effective power of first drive pulse P1 is incremented by one level, and then second drive pulse P11, having the effective power one or several levels higher than that of first drive pulse P1, is output if necessary. As described above, most of the time the load increase of rotor 13 is caused by the increased meshing load of gear train 50 due to the dispersion of minute dimensional irregularities in production or assembly processes and the continued higher load condition of rotor 13 is usually due to the meshing load caused by manufacturing/assembly tolerances or because of a varied meshing condition caused by the larger torque of auxiliary pulse P2. As a result, these higher load conditions are cyclical and tend to return to the initial condition after several consecutive rotations of rotor 13 after which time rotor 13 can be rotated by the initial lower-torque, drive pulse P1. As a result, the number of incremental rotational angles which requires pulses having a larger effective power to overcome the increased load is small. Accordingly, as is shown in this embodiment, it is possible to drive through the incremental rotational angles having a larger load, without rotational errors, by applying drive pulses P11, having a somewhat higher effective power than that of drive pulse P1, following a cycle in which auxiliary pulse P2 was supplied. Furthermore, because by supplying drive pulse P11 it is not necessary to continuously apply auxiliary pulses P2 having a very large torque, gear train 50 will return to a low-torque condition sooner and power consumption will be reduced. Once the rotation angles having increased meshing load have passed, it is then possible to drive rotor 13 by applying drive pulse P1 having a minimum effective power. Accordingly, the drawback of conventional systems, in which drive pulses are supplied having an energy level one or two or more increment levels higher than the level that is actually required to drive rotor 13, is avoided, thereby enabling the further reduction of power consumption in driving stepping motor 10.

Figure 4:
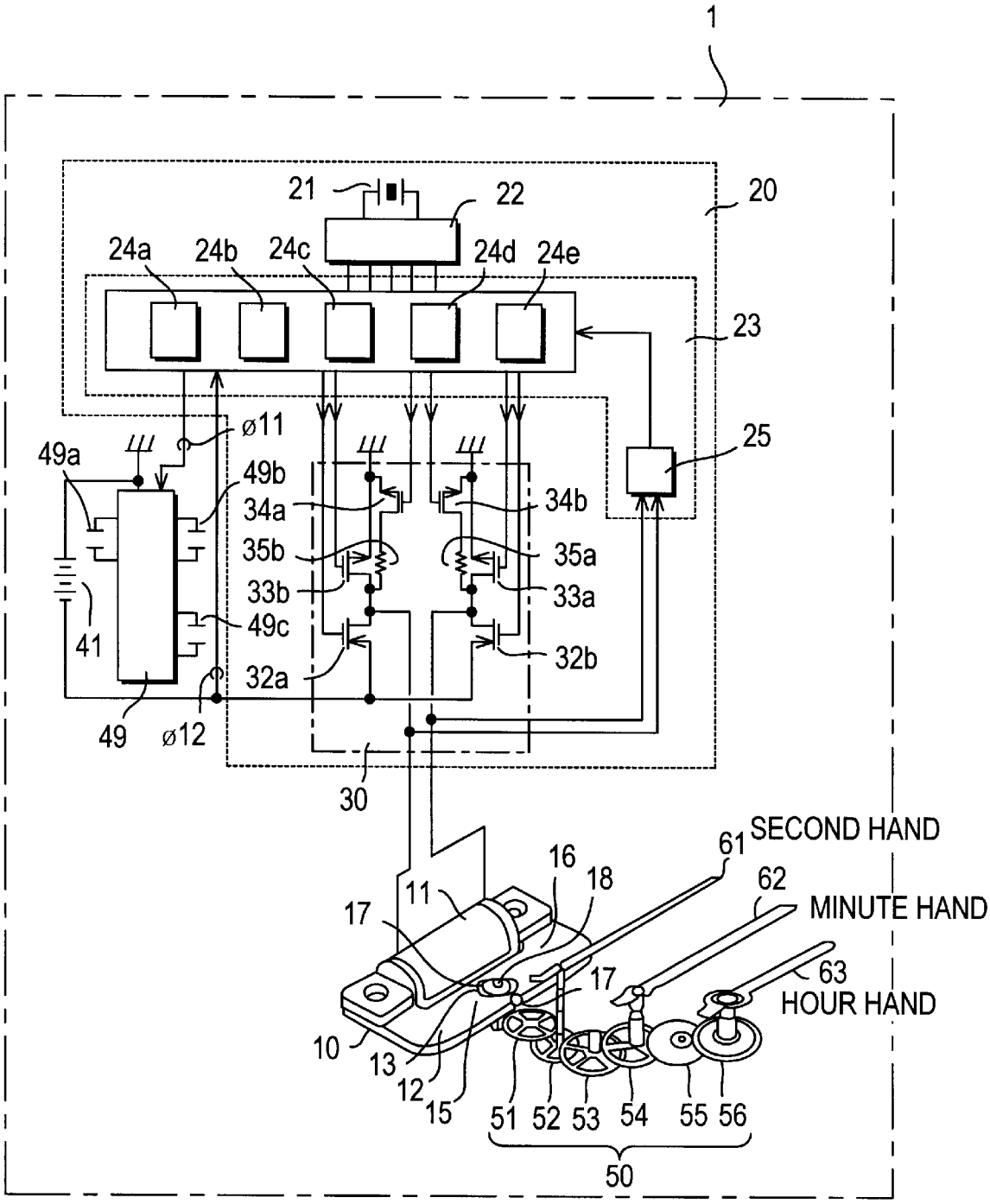
FIG. 4 is a schematic representation of a timepiece including a stepping motor and a generation device constructed in accordance with the second embodiment of the invention.

Referring now to FIG. 4, there is shown a schematic diagram of timepiece 1 constructed in accordance with the second embodiment of the present invention. Because timepiece 1 of this embodiment has the same basic construction as the embodiment described in FIG. 1, common elements will be denoted with like references and a detailed description thereof will be omitted.

Control circuit 23' employed in timepiece 1 includes drive pulse supply part 24*a* for supplying drive pulse P1, rotation-detecting pulse supply part 24*b* for producing rotation-detecting pulses SP2 to detect rotation of rotor 13, and auxiliary pulse supply part 24*c* for outputting auxiliary pulse P2. Auxiliary pulse supply part 24*c* of drive control circuit 24 outputs auxiliary pulse P2, having larger effective power than drive pulse P1, when detection circuit 25 detect that rotor 13 rotated, as described in the conventional circuit above. Degaussing pulse supply part 24*d* supplies degaussing pulse PE. However, while in the conventional circuit degaussing pulse PE is output immediately following auxiliary pulse P2, in this embodiment the output of degaussing pulse PE is delayed to immediately before the next drive pulse P1. In this way, the effective power of the next drive pulse P1 is substantially enhanced and is sufficient energy for rotating rotor 13. Accordingly, it is possible to apply drive pulse P1 having substantially larger effective power in a cycle following the output of auxiliary pulse P2 without increasing the actual energy of drive pulse P1 for rotating through rotation angles having increased meshing loads. Also, by increasing the effective power of drive pulse P1, it is possible to prevent the consecutive application of a plurality of auxiliary pulses P2 thereby allowing the meshing condition to return to its low initial meshing load sooner.

Accordingly, control circuit 20 in this embodiment drives stepping motor 10 with drive pulse P1 having a minimum effective power once after the increments of rotation angles having increased load due to meshing tolerances or a shift in shaft position are overcome and lower meshing load conditions return. This serves to greatly reduce the possibility that a drive pulse having an effective power several levels larger than the minimum level necessary will be output, as in conventional systems, thereby further reducing power consumption by stepping motor 10.

Figure 5:
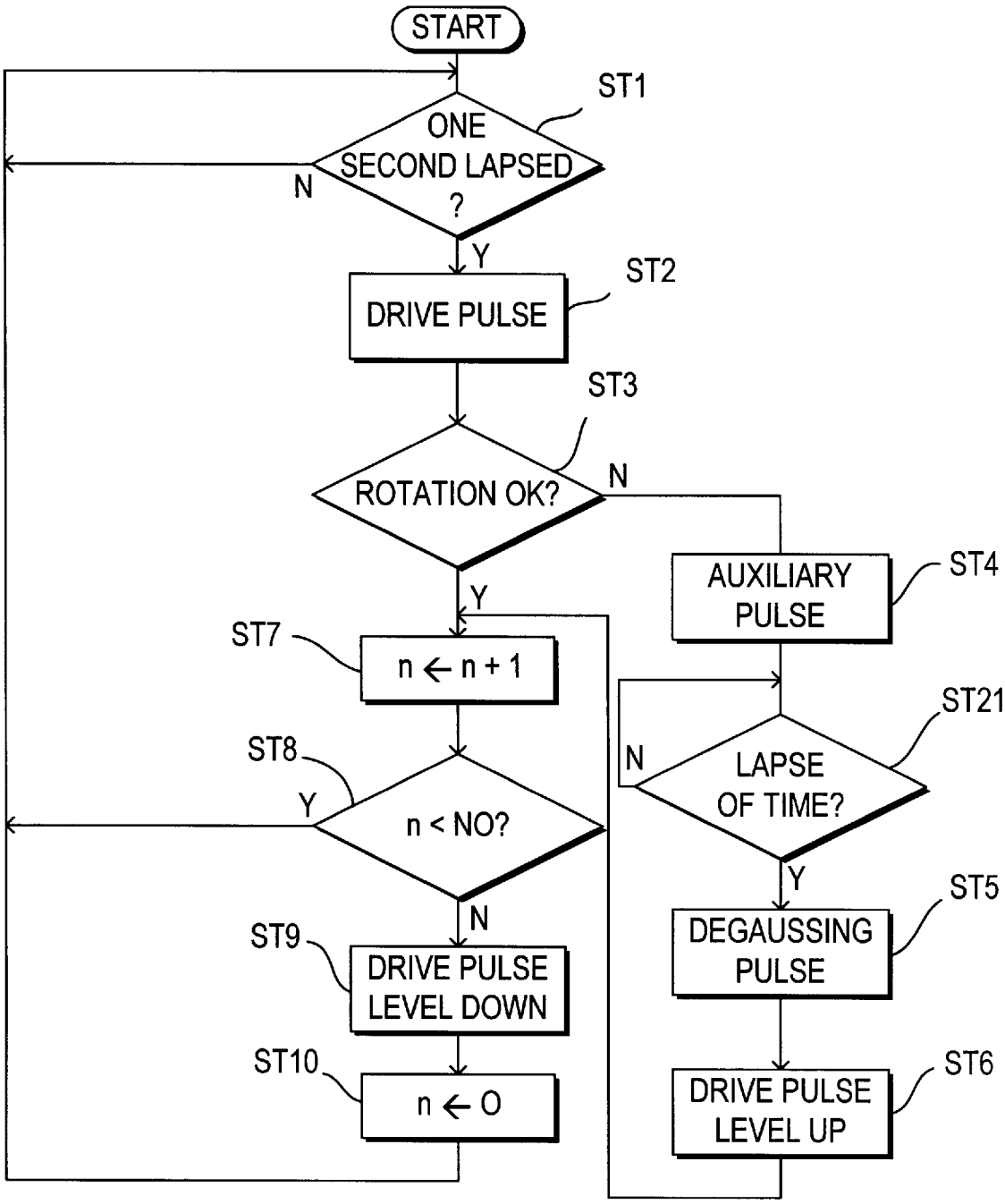
FIG. 5 is a flow chart illustrating the control method of the control device shown in FIG. 4.

Referring now to FIG. 5, there is shown a flow chart of the method of controlling stepping motor 10 employed in timepiece 1 according to the present embodiment. Flowchart steps that correspond to steps previously described in FIG. 8 are denoted by the same reference numerals and a detailed description thereof is omitted.

First, in step ST1, one second of time is measured for moving hands. If it is determined that one second has elapsed, then in step ST2, drive pulse P1 is supplied. Next, in step ST3, rotation detecting pulse SP2 is output for determining whether rotor 13 has rotated. If rotation is not detected, the method proceeds to step ST4 in which auxiliary pulse P2, having a larger effective power than drive pulse P1, is applied. The output of degaussing pulse PE is delayed by an amount of time measured in step ST21. After the amount of time passes, degaussing pulse PE is output in step ST5 just before the start of the next cycle at which time the next drive pulse P1 is output. After degaussing pulse PE is output, the effective power of drive pulse P1 is incremented by one level and the methods proceeds to step ST7. Accordingly, the control method of this embodiment increases the effective power of drive pulse P1 by one increment level after auxiliary pulse P2 is output and avoids the need to increase the effective power of drive pulse P1 two or more levels consecutively by utilizing degaussing pulse PE to increase the effective power of drive pulse P1.

If the rotation of rotor 13 is detected in step ST3, auxiliary pulse P2 is not output and, in step ST7, counter n is incremented and compared with first predetermined number NO in step ST8. If counter n is equal to predetermined number NO, the effective power of drive pulse P1 is further reduced by one increment in step ST9 to achieve power savings and, thereafter, counter n is initialized to zero in step ST10.

Figure 6:
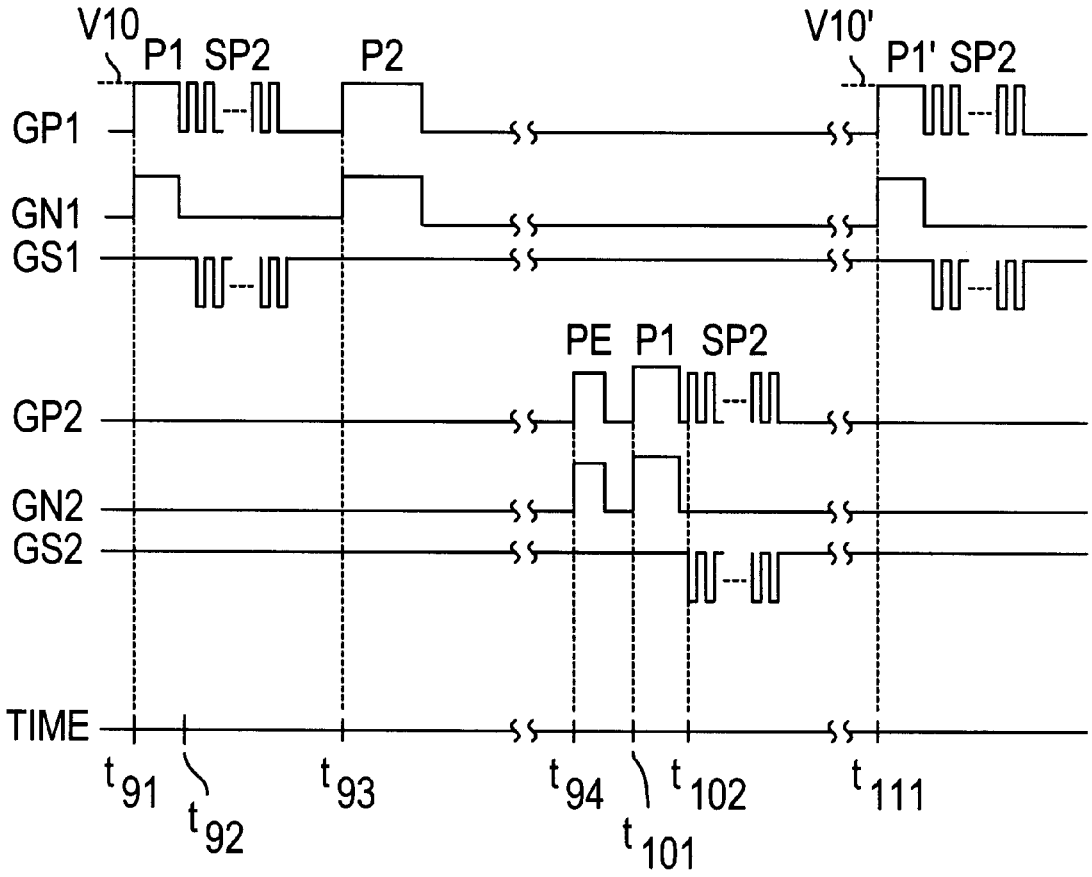
FIG. 6 is a timing chart illustrating the operation of the control device in accordance with the method of FIG. 4.

Referring now to FIG. 6, there is shown a timing chart illustrating the operation of control device 20 in the present embodiment. As with the embodiment described previously in FIG. 3, FIG. 6 illustrates the control signals applied to each of gates GP1, GN1 and GS1 of p-channel MOSFET 33*a*, n-channel MOSFET 32*a* and p-channel MOSFET 34*a*, respectively, for sampling and those control signals applied to each of gates GP2, GN2 and GS2 of p-channel MOSFET 33*b*, n-channel MOSFET 32*b* and p-channel MOSFET 34*b*, respectively, for sampling, by drive circuit 30. Like elements to those described in FIG. 3 are denoted by the same reference numerals and a detailed description thereof is omitted.

The initial cycle starts at time t91 by first applying drive pulse P1, having a voltage V10, to the driving pole side and afterwards, at time t92, supplying rotation detecting pulse SP2. Then, if the rotation of rotor 13 is not detected due to an increased meshing load, auxiliary pulse P2, having a larger effective power than drive pulse P1, is applied to the driving pole side at time t93. Next, at time t94, which is immediately prior to time 101 when the next cycle starts, degaussing pulse PE is output to the opposite pole side. Immediately after the output of degaussing pulse PE, the next cycle starts and the next drive pulse P1 is output on the driving pole side which is the opposite the driving pole side of the previous cycle. In this way, the combination of degaussing pulse PE and drive pulse P1 increase the substantial effective power available to rotate rotor 13 even during rotation angles having increased meshing loads caused by the output of auxiliary pulse P2 in a previous cycle.

If the rotation of rotor 13 is detected by rotation detecting pulse SP2 at time t102, in the next cycle at time till, drive pulse P1', having a voltage V10' (where V10'>V10) i.e. a drive pulse having energy one increment level higher than before the auxiliary pulse P2 was output at time 93, is supplied.

As described above, timepiece 1, according to the present embodiment, provides a drive pulse having a substantially higher effective power by either supplying second drive pulse P11 having a larger effective power than drive pulse P1 or by delaying the output of degaussing pulse PE to a time immediately prior to the next drive pulse P1 after an auxiliary pulse P2 was output. In this way, accurate movements of the hands are provided even during increased meshing loads caused by the meshing tolerances which affect stepping motor 10 for very short periods, without the need to increase the actual power of drive pulse P1 more than is required. When the meshing tolerance returns to the initial low conditions and the meshing load on stepping motor 10 is reduced, drive pulse P1', having an energy level of approximately one increment higher than the predetermined effective power of drive pulse P1, is applied. Thus, in contrast to the conventional system in which the effective power of drive pulse P1 used to drive stepping motor 10 is raised several increments above the minimum required level due to almost instantaneous meshing load increases, under the present invention, a control system is provided in which rotor 13 is successfully rotated even during instantaneous load increases and drive pulses having an effective power at the minimum level required to drive rotor 13 are provided when the meshing load returns to normal levels. Accordingly, power consumption of stepping motor 10 is further reduced, as compared to conventional systems, so that a smaller, long-lasting timepiece and a self-generating type timepiece able to work continuously even after being left motionless for a long time can be provided.

Application of this invention is of course not limited only to timepieces, such as wristwatches, but also may apply to multi-purpose timepieces such as chronographs or other power generating systems and devices incorporating a stepping motor. Furthermore, it will be obvious to one of ordinary skill in the art that the waveforms described above, including drive pulse P1, auxiliary pulse P2 and rotation detecting pulse SP2, are used just as an example and they can be set in accordance with the characteristics of stepping motor 10. Also, it will be obvious to one of ordinary skill in the art that the present invention can also be applied to a stepping motor having three phases or more, even though the above descriptions with respect to timepiece 1 use a two-phase stepping motor 10 as a example. Also, instead of performing common control of each phase, the drive pulses may be provided having pulse widths and timing appropriate for each phase. Also, the drive method of stepping motor 10 is not limited to single phase magnetization but may also be use two-phase magnetization or one-two phase magnetization.

As described above, the control method and control device according to the present invention is capable of driving stepping motor 10 with lower power consumption than conventional systems by gradually reducing the effective power of the drive pulses used to drive stepping motor 10 when rotor 13 is consecutively rotated by drive pulse P1. Furthermore, even in the case of instantaneous meshing load increases due to the meshing tolerances of gear train 50 or the output of auxiliary pulse P2, the present invention provides a method that overcomes these conditions and provides drive pulses having the minimum effective power that is necessary to drive rotor 13. Accordingly, the power consumption of control device 10 under this invention is much lower than in conventional systems making it suitable for timepieces that are small-sized and long-lasting and that incorporate an electric generator for eliminating the need to use batteries.

The invention accordingly comprises the several steps and the relation of one or more of such steps with respect to each of the others, and the apparatus embodying features of construction, combinations of elements, and arrangement of parts which are adapted to effect such steps, all as exemplified in the following detailed description disclosure, and the scope of the invention will be indicated in the claims.

I claim:

1. A device for controlling a stepping motor, the stepping motor including a multi-poled rotor that is rotatably driveable within a stator having a drive coil, comprising:

first driving means for supplying a first drive pulse to said drive coil for rotating said rotor, said first drive pulse having an effective power;

rotation detection means for detecting whether said rotor has rotated in response to said first drive pulse;

auxiliary means for supplying an auxiliary pulse having an effective power that is larger than said effective power of said first drive pulse when the rotation of said rotor is not detected;

level adjustment means for decrementing the effective power of said first drive pulse after said rotor has rotated for a first predetermined number of times consecutively; and second driving means for applying a second drive pulse having an effective power that is higher than the effective power level of said first drive pulse and lower than said effective power of said auxiliary pulse, the effective power of said second drive pulse being adjusted by said level adjustment means, said second drive pulse being output for a second predetermined number of times after said auxiliary pulse is supplied.

2. The device for controlling a stepping motor of claim 1, wherein said second pulse has a pulse width and said second driving means varies said effective power by varying the pulse width of said drive pulse.

3. The device for controlling a stepping motor of claim 1, wherein said second drive pulse has a voltage and said second driving means varies said effective power of said second drive pulse by varying said voltage of said second drive pulse.

4. A device for controlling a stepping motor, the stepping motor including a multi-poled rotor that is rotatably driveable within a stator having a drive coil, comprising:

driving means for applying a drive pulse to said drive coil for rotating said rotor, said drive pulse having an effective power;

rotation detection means for detecting whether said rotor has rotated in response to said drive pulse;

level adjustment means for decrementing the effective power of said first drive pulse after said rotor has rotated for a first predetermined number of times consecutively;

auxiliary means for supplying an auxiliary pulse having an effective power that is larger than said effective power of said drive pulse when the rotation of said rotor is not detected, said auxiliary pulse having a polarity; and degaussing pulse applying means for applying a degaussing pulse having a polarity that is opposite to said polarity of said auxiliary pulse;

wherein a following drive pulse is output following said auxiliary pulse, and said degaussing pulse is output immediately prior to said following drive pulse.

5. A method for controlling a stepping motor, the stepping motor including a multi-poled rotor that is rotatably driveable within a stator having a drive coil, comprising the steps of:

supplying a first drive pulse to said drive coil for rotating said rotor, said first drive pulse having an effective power;

detecting whether said rotor has rotated in response to said first drive pulse;

applying an auxiliary pulse having an effective power that is larger than said effective power of said first drive pulse when the rotation of said rotor was not detected;

decrementing said effective power of said first drive pulse after said rotor has rotated for a first predetermined number of times consecutively;

applying a second drive pulse having an effective power that is higher than said effective power of said first drive pulse and lower than said effective power of said auxiliary pulse, said second drive pulse being output for a second predetermined number of times after said auxiliary pulse is supplied; and adjusting said effective power of said second drive pulse.

6. The method for controlling a stepping motor of claim 5, wherein said second drive pulse has a pulse width and said adjusting step adjusts said effective power of said second drive pulse by varying the pulse width of said second drive pulse.

7. The method for controlling a stepping motor of claim 5, wherein said second drive pulse has a voltage and said adjusting step adjusts said effective power of said second drive pulse by varying said voltage of said second drive pulse.

8. A method for controlling a stepping motor, the stepping motor including a multi-poled rotor that is rotatably driveable within a stator having a drive coil, comprising the steps of:

supplying a drive pulse to said drive coil for rotating said rotor, said drive pulse having an effective power;

detecting whether said rotor has rotated in response to said drive pulse;

decrementing said effective power of said drive pulse after said rotor has rotated for a first predetermined number of times consecutively;

applying an auxiliary pulse having an effective power that is larger than said effective power of said drive pulse when the rotation of said rotor was not detected, said auxiliary pulse having a polarity;

applying a degaussing pulse having an polarity that is opposite of said polarity of said auxiliary pulse, said degaussing pulse being applied after application of said auxiliary pulse; and supplying a following drive pulse immediately after said degaussing pulse.

9. A timepiece, having a plurality of hands, comprising:

a device for controlling a stepping motor for driving said hands, the stepping motor including a multi-poled rotor that is rotatably driveable within a stator having a drive coil, the device comprising:

first driving means for supplying a first drive pulse to said drive coil for rotating said rotor, said first drive pulse having an effective power;

rotation detection means for detecting whether said rotor has rotated in response to said first drive pulse;

auxiliary means for supplying an auxiliary pulse having an effective power that is larger than said effective power of said first drive pulse when the rotation of said rotor is not detected;

level adjustment means for decrementing the effective power of said first drive pulse after said rotor has rotated for a first predetermined number of times consecutively; and second driving means for applying a second drive pulse having an effective power that is higher than the effective power level of said first drive pulse and lower than said effective power of said auxiliary pulse, the effective power of said second drive pulse being adjusted by said level adjustment means, said second drive pulse being output for a second predetermined number of times after said auxiliary pulse is supplied.

10. A device for controlling a stepping motor, the stepping motor including a multi-poled rotor that is rotatably driveable within a stator having a drive coil, comprising:

a first drive pulse supply part coupled to said drive coil for supplying a first drive pulse to said drive coil for rotating said rotor, said first drive pulse having an effective power;

a rotation detecting pulse supply part coupled to said drive coil for detecting whether said rotor has rotated in response to said first drive pulse;

an auxiliary pulse supply part coupled to said drive coil for supplying an auxiliary pulse having an effective power that is larger than said effective power of said first drive pulse when the rotation of said rotor is not detected;

second drive pulse having an effective power that is higher than the effective power level of said first drive pulse and lower than said effective power of said auxiliary pulse, the effective power of said second drive pulse being adjusted by said level adjustment part, said second drive pulse being output for a second predetermined number of times after said auxiliary pulse is supplied.

11. The device for controlling a stepping motor of claim 10, wherein said second pulse has a pulse width and said second driving pulse supply part varies said effective power by varying the pulse width of said drive pulse.

12. The device for controlling a stepping motor of claim 10, wherein said second drive pulse has a voltage and said second driving pulse supply part varies said effective power of said second drive pulse by varying said voltage of said second drive pulse.

13. A device for controlling a stepping motor, the stepping motor including a multi-poled rotor that is rotatably driveable within a stator having a drive coil, comprising:

drive pulse supply part coupled to said drive coil for applying a drive pulse to said drive coil for rotating said rotor, said drive pulse having an effective power;

a rotation detection pulse supply part coupled to said drive coil for detecting whether said rotor has rotated in response to said drive pulse;

a level adjustment part for decrementing the effective power of said first drive pulse after said rotor has rotated for a first predetermined number of times consecutively;

an auxiliary pulse supply part coupled to said drive coil for supplying an auxiliary pulse having an effective power that is larger than said effective power of said drive pulse when the rotation of said rotor is not detected, said auxiliary pulse having a polarity; and a degaussing pulse supply part electrically coupled to said drive coil for applying a degaussing pulse having a polarity that is opposite to said polarity of said auxiliary pulse;

wherein a following drive pulse is output following said auxiliary pulse, and said degaussing pulse is output immediately prior to said following drive pulse.

14. A timepiece, having a plurality of hands, comprising:

a first drive pulse supply part coupled to said drive coil for supplying a first drive pulse to said drive coil for rotating said rotor, said first drive pulse having an effective power;

a rotation detecting pulse supply part coupled to said drive coil for detecting whether said rotor has rotated in response to said first drive pulse;

an auxiliary pulse supply part coupled to said drive coil for supplying an auxiliary pulse having an effective power that is larger than said effective power of said first drive pulse when the rotation of said rotor is not detected;

a level adjustment part for decrementing the effective power of said first drive pulse after said rotor has rotated for a first predetermined number of times consecutively; and a second drive pulse supply part coupled to said drive coil for applying a second drive pulse having an effective power that is higher than the effective power level of said first drive pulse and lower than said effective power of said auxiliary pulse, the effective power of said second drive pulse being adjusted by said level adjustment part, said second drive pulse being output for a second predetermined number of times after said auxiliary pulse is supplied.

* * * * *